US011488449B1

(12) United States Patent
Fishon

(10) Patent No.: US 11,488,449 B1
(45) Date of Patent: Nov. 1, 2022

(54) METHOD AND SYSTEM FOR NORMALIZING SECONDARY AWARD OPPORTUNITIES FOR PLAYERS PLACING WAGERS HAVING DIFFERENT HOUSE ADVANTAGES

(71) Applicant: Todd Fishon, Henderson, NV (US)

(72) Inventor: Todd Fishon, Henderson, NV (US)

( * ) Notice: Subject to any disclaimer, the term of this patent is extended or adjusted under 35 U.S.C. 154(b) by 159 days.

(21) Appl. No.: 16/946,518

(22) Filed: Jun. 25, 2020

(51) Int. Cl.
*G07F 17/00* (2006.01)
*G07F 19/00* (2006.01)
*G07F 17/32* (2006.01)

(52) U.S. Cl.
CPC ..... *G07F 17/3267* (2013.01); *G07F 17/3255* (2013.01); *G07F 17/3258* (2013.01); *G07F 17/3288* (2013.01)

(58) Field of Classification Search
CPC ..... G07F 17/3255; G07F 17/3258; G07F 17/3267; G07F 17/3288; G07F 17/34
See application file for complete search history.

(56) References Cited

U.S. PATENT DOCUMENTS

| | | | | |
|---|---|---|---|---|
| 6,413,160 | B1 * | 7/2002 | Vancura | G07F 17/3244 463/16 |
| 7,997,981 | B2 * | 8/2011 | Rowe | G07F 17/32 463/28 |
| 8,342,956 | B2 | 1/2013 | Anderson | |
| 9,053,601 | B2 | 6/2015 | Seelig et al. | |
| 2006/0223615 | A1 | 10/2006 | Englman | |
| 2009/0275379 | A1 * | 11/2009 | Hsu | G07F 17/3211 463/17 |
| 2012/0034965 | A1 * | 2/2012 | Masen | G07F 17/32 463/20 |
| 2014/0057705 | A1 * | 2/2014 | Elias | G07F 17/3244 463/25 |
| 2015/0221168 | A1 * | 8/2015 | Spark-Stahl | G07F 17/3244 463/25 |
| 2018/0253930 | A1 | 9/2018 | Acres | |
| 2021/0065506 | A1 * | 3/2021 | Oberberger | G07F 17/3286 |

* cited by examiner

*Primary Examiner* — Milap Shah
(74) *Attorney, Agent, or Firm* — Weide & Miller, Ltd.

(57) ABSTRACT

A system and method for awarding secondary prizes, such as relative to wagering events presented at gaming machines and gaming tables, is provided. A player receives a different number of opportunities, such as prize entries, for wagers placed on different wagering events having different house advantages, and preferably where each prize entry has its own win/lose outcome.

14 Claims, 2 Drawing Sheets

METHOD AND SYSTEM FOR NORMALIZING SECONDARY AWARD OPPORTUNITIES FOR PLAYERS PLACING WAGERS HAVING DIFFERENT HOUSE ADVANTAGES

FIELD OF THE INVENTION

The present invention relates to methods and systems for awarding game players with prizes.

BACKGROUND OF THE INVENTION

Given that players of casino wagering games often lose more money than they win in a particular gaming session, casinos often use secondary or additional rewards as a means for rewarding players and further enticing game play. One informal way of doing this is age-old: provide players with free drinks while they are playing.

As another way of rewarding more of the amounts wagered by players, a casino may modify a game to include a specific secondary award. For example, relative to a table game, a player might be issued an entry ticket in a secondary prize drawing, where the secondary prize is funded by the casino out of winnings (generally or from the particular table). For example, a player might be awarded a secondary prize drawing ticket if a player achieves a certain predetermined game outcome (such as receiving a suited Blackjack on a Blackjack game). Not only is this a labor-intensive system that requires physical tickets (such as by the dealer, thus also slowing the game down), but it requires players to accumulate tickets for the drawing and enter them into the drawing. Moreover, such a drawing does not allow for the tickets to be distributed based on the actual worth of a player. Such a system also doesn't allow for an instant notification of winning a prize, as players must instead place their tickets into a drawing hopper for a drawing that is held at a certain later time, doesn't ensure fairness and accountable distribution of entry tickets, and doesn't allow for progressive prize pools to be included in the prize offerings.

Similarly, relative to a gaming machine or a group of gaming machines, a casino might implement a secondary award. For example, a slot-style gaming machine may have a paytable of base awards and an average house hold. A portion of this house hold may further be returned to the players of the gaming machine by generating a progressive jackpot from a portion of the house hold on the gaming machine (such as by allocating a small portion of each wager at the gaming machine to the jackpot). This concept may be expanded to a group of linked gaming machines via a "progressive system" where one or more progressive jackpots are associated with two or more gaming machines. However, a problem with these types of systems is that they may link different wagering devices together even though those devices may present wagering games having entirely different house advantages for the same wager—whereby some players are effectively contributing more to the progressive jackpot than others, while having the exact same opportunity or chance to win as the other players.

Over time, casinos have thus sought ways to award secondary rewards which are not necessarily linked to a particular game and in a manner which distinguishes players based upon their wagering activity—e.g. awarding players who wager more with higher value awards than those who do not. Casinos created player tracking systems as one way to track player play of player game play, such as at any gaming machines in a casino. Typically, these tracking systems require a player to identify themselves when they play a gaming machine, such as by inserting a player tracking card that identifies the player. The player's activities at the gaming machine can be tracked. Points may be awarded, for example, based upon a player's gaming activity, wherein accrued levels of points may yield different awards to the player.

Accurately valuing table game players, especially the mid-level player as compared to the "high rollers" that are personally catered to by casino executives, is a long-standing problem that exists in individualizing the actual value of each player. Originally, one problem was that it was simply difficult to even track the amounts wagered by different players at a gaming table (where, unlike a gaming machine where wagers are placed via electronic credits registered at the gaming machine which are fully trackable by the machine, wagers placed at a gaming table are typically made via chips). This problem has partially been solved through the use of RFID or optical chip recognition, thus allowing the system to "read" the chips placed by each player and thus determined a value of the wagers placed by a player and amounts won (via exchanges of chips).

While electronic gaming devices can capture data regarding each wager made, existing casino systems are simply configured to track the amount of money that a player wagered throughout their gaming session. The term for the amount of money wagered is identified as "Coin In" or "Handle". With this information, the casino applies one house advantage to the "Handle" which will calculate a term called "Theoretical Expectation"—which is the amount of money the casino expects to win from the player's gaming session. From this "Theoretical Expectation", a casino will determine the size of an award that should be awarded to a player.

This methodology, however, has numerous problems and drawbacks. Currently, if multiple game types are offered, where each game type consists of multiple different wager types, the player's worth will be calculated using a single advantage value. This results in players not being rewarded based upon their actual value to the casino. For example, a $100 wager on a hand of Blackjack is worth around $1 to the casino, while the same bet on Roulette is worth $5.26, and if it was placed on a Blackjack side wager, it could be worth as much as $10 or more. Thus, a system which rewards each player who placed a $100 on those different types of games with the same reward, is essentially unfair.

An improved system and method for awarding secondary prizes to players which overcomes these and other problems, is desired.

SUMMARY OF THE INVENTION

Aspects of the invention comprise methods and systems for awarding secondary awards or prizes to players of wagering games.

One embodiment of the invention is a system and method for awarding secondary prizes where there are different allocations of funds to a secondary award prize pool based upon wagers placed on wagering events having different house advantages.

Another embodiment of the invention is a system and method for awarding secondary prizes where a player receives a different number of opportunities, such as prize entries, for wagers placed on different wagering events having different house advantages, and preferably where each prize entry has its own win/lose outcome.

Another embodiment of the invention is a system and method for awarding secondary prize opportunities, such as entries, as funded by underlying game wagers, where the number of opportunities varies based upon the underlying wagering event (and particularly, the house advantage) and there is a win/lose outcome for each secondary prize entry.

Yet another embodiment of the invention is a system and method for developing a prize pool that joins two or more game types and different wager types within each game, and allows each wager type/game type to participate in the same prize pool.

Another embodiment of the invention is a system and method which allows players to win prizes based on accruing opportunities, such as entries, that are dependent on the value of each wager that they make. Each wager is assigned a certain number of entries based on the total worth of the wager. The system effectively allocates or assigns a portion of the casino's advantage for each wager and applies that allocation to a prize fund that can be used for prizes that can be won by the players. The prize pool can consist of progressive prize pools, promotional awards such as food credits, and cash prizes.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a method and system providing and determining secondary award opportunities for players. Most preferably, the method and system normalizes secondary award opportunity for players who place wagers having different house advantages. In other words, secondary awards are provided to players based upon the true worth of each player's individual wager, when considering the different house advantages for different wagers.

Figure 1:
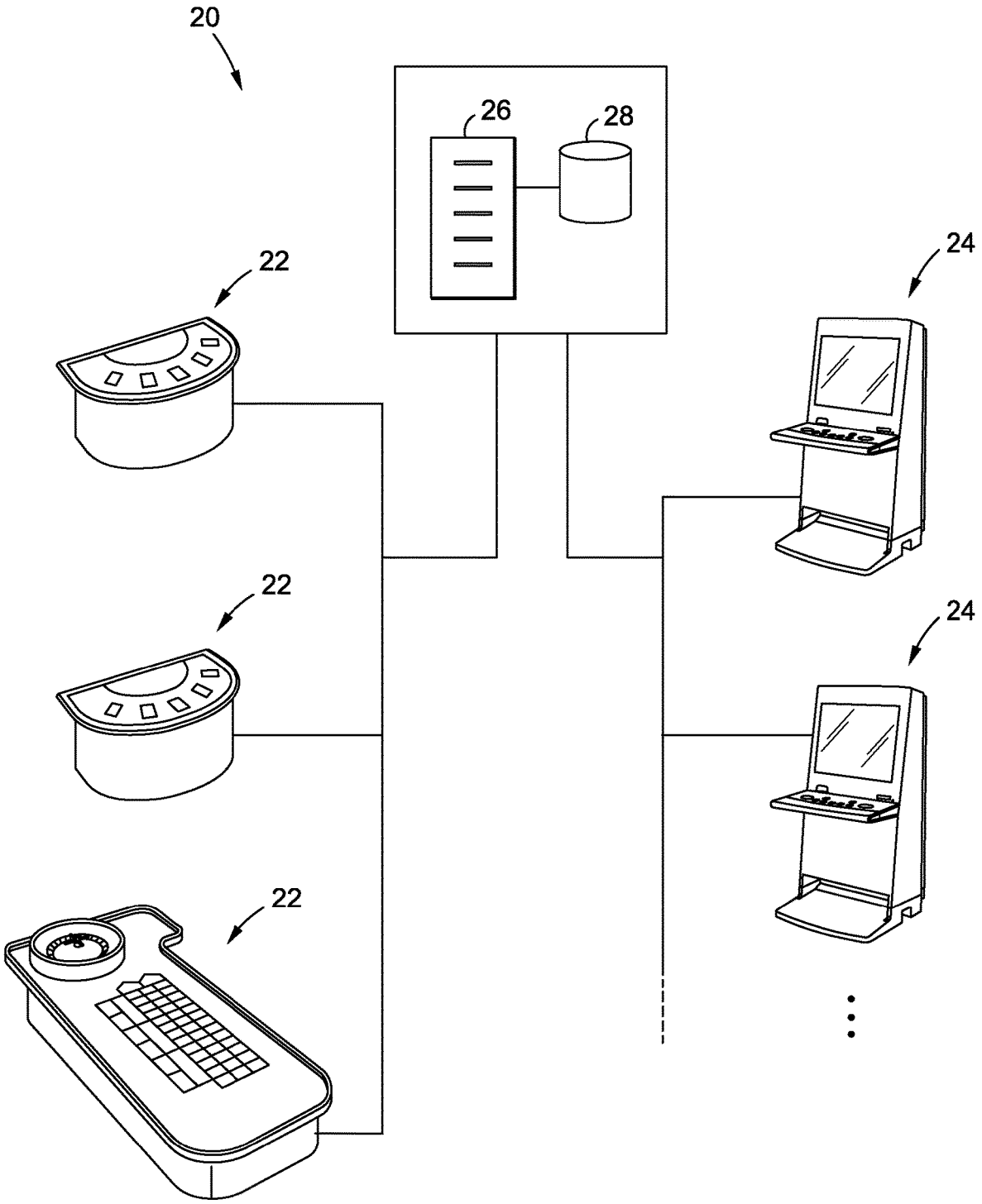
FIG. 1 illustrates a system in accordance with an embodiment of the invention.

One embodiment of a system 20 of the invention will be described with reference to FIG. 1. As illustrated, the system 20 preferably comprises one or more gaming devices. The gaming devices may comprise gaming tables 22 at which one or more wagering events are presented. For example, such a gaming table 22 might be a table at which one or more wagering card games are presented (such as, but not limited to, poker games, Pai Gow, blackjack, baccarat, etc.), or dice games (such as, but not limited to, Craps), roulette, or various other games now known or later developed.

As one example, relative to a gaming table 22 at which a card game is presented, the gaming table 22 may define a top or playing surface. The gaming table 22 may include one or more supports, such as a base, legs or the like via which the playing surface is elevated above a supporting surface such as a gaming floor. The shape of the playing surface may vary. In one embodiment, the gaming table 22 has a rear having a rear edge which is generally straight and has an opposing front having a front edge which is generally arcuate. A bumper or cushion may be located at either or both edges.

In one embodiment, the playing surface is generally planar. However, the playing surface could have one or more raised areas and/or one or more depressed areas or other features which are integrated into the table or added to the table, such as by being located on or mounted to the top surface thereof. Various game-related information or features are preferably associated with the gaming table 22. In one embodiment, the playing surface comprises a gaming felt or similar element(s) which are located over a substrate, such as a planar support. The gaming felt may bear game play information or other information, such as by printing on the felt. This information may vary, such as depending upon the game or games which are to be implemented at the gaming table 22.

In one embodiment, the configuration of the gaming table 22, such as via elements which are associated with the table and information printed on the gaming felt, defines a dealer station where a dealer may run a game, and one or more player positions. The dealer station is generally located at the rear edge and the player positions are located opposite the dealer station at the front or front edge. The dealer may, for example, stand at the rear of the table adjacent to the dealer station. A player may stand or sit adjacent to each player position at the front of the gaming table 22.

For example, printing on the gaming felt may comprise one or more pay tables, player card locations (e.g. one or more designated areas at or into which one or more cards may be dealt), a dealer card location, and if the game includes community cards, one or more community card locations. Printing on the felt, one or more displays or plaques or the like may display game rules, pay tables and other game information.

Of course, the gaming table 22 might have other configurations, such as depending upon the game that is being presented at the table. For example, relative to a dice game such as Craps, the table might be generally oval in shape and have an upwardly extending outer sidewall, where the table surface is set inside the sidewall and below a top of the sidewall. Relative to a game such as roulette, the gaming table may include a spinnable roulette wheel.

It will be appreciated that the games presented at the gaming tables 22 may have various rules, including rules for determining winning and losing outcomes. The games may also have various wagering options, including required and optional wagers. For example, a card game might have a requires ante wager, one or more play wagers (or raise or call wagers) which are required to remain in game through various stages of the game until a winning or losing outcome is determined (where if a play wager is not placed, the player might forfeit their wagers), and various bonus or side wagers, which bonus or side wagers are often optional. Each of these wagers may have a different winning and losing probability, which probability may or may not depend upon decisions made by a player. These different winning and losing probabilities thus mean that each wager may have a different house advantage. For example, in the game of baccarat, a "player hand" or "banker hand" wager has a 1.14% house advantage, while a "tie" wager has a house advantage of 14.00%. Side wagers may have different house advantages, such as depending upon the particular wager and the odds of winning or losing. For example, a side wager might have a house advantage of 7-8% or more.

The gaming tables 22 may utilize a dealer to manage the game, such as by dealing cards or managing other game pieces, as well as distributing and collecting chips, etc. In other embodiments, the gaming tables 22 might be electronic gaming tables or stations, such as where game information is generated and displayed to players via one or more displays, and wherein player inputs may be provided electronically.

The system 20 may include one or more gaming machines 24. The gaming machines 24 may have a variety of configurations, but may comprises a housing or cabinet for supporting and/or enclosing various components required for operation of the gaming machine. In the embodiment, the housing may include a door located at a front thereof, the door capable of being moved between an open position which allows access to the interior, and a closed position in which access to the interior is generally prevented. The gaming machine may have an "upright" configuration, but could have other configurations, shapes or dimensions (such as being of a "slant"-type, "bar-top" or other configuration as is well known to those of skill in the art).

The gaming machine preferably includes at least one first display device configured to display game information. The display device may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display device may be capable of projecting or displaying a wide variety of information, including images, symbols and other indicia or information associated with game play, game promotion or other events. The gaming machine might include more than one display device, such as a main or first display device and a secondary display device. The two or more display devices might be associated with the housing or the gaming machine might also include a top box or other portion which includes the one or more second display devices. Also, the gaming machine might include side displays (such as mounted to the exterior of the housing) and might include multiple displays of differing sizes.

The gaming machine is preferably configured to present one or more games upon a player making a monetary payment or wager. In this regard, as described in more detail below, the gaming machine may include mechanism or means for accepting monetary value.

In one embodiment, as noted above, certain base game outcomes and side bonus outcomes (but preferably not all outcomes) may be designated as winning outcomes (the non-winning outcomes may be referred to as losing outcomes) and awards may be provided for winning outcomes, such as monetary payments (or representations thereof, such as prize of credits) as detailed herein. As detailed below, the gaming machine preferably includes a mechanism or means for returning unused monetary funds and/or dispensing winnings to a player.

The gaming machine preferably includes one or more player input devices (such as input buttons, plunger mechanisms, a touch-screen display, joystick, touch-pad or the like). These one or more devices may be utilized by the player to facilitate game play, such as by providing input or instruction to the gaming machine. For example, such input devices may be utilized by a player to place a wager, cause the gaming machine 24 to initiate a game, to "cash out" of the gaming machine, or to provide various other inputs.

In one preferred embodiment, the gaming machine 24 includes at least one microprocessor or controller for controlling the gaming machine, including receiving player input and sending output signals for controlling the various components or peripheral devices of the machine 24 (such as generating game information for display by the display devices). The controller may be arranged to receive information regarding funds provided by a player to the gaming machine 24, receive input such as a purchase/bet signal when a purchase/bet button is depressed, and receive other inputs from a player. The controller may be arranged to generate information regarding a game, such as generating base game information for display by the at least one display device (such as information comprising dealt cards, etc.), for determining winning or losing base game outcomes and for displaying information regarding awards for winning game wagers, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information including tracked game play information). The gaming machine 24 may also include one or more random number generators for generating random numbers (such as implemented by a random number generator software module stored in the memory and executable by the processor), such as for use in selecting the playing cards and for presenting the base game in a random fashion (e.g. whereby the game is presented in a manner in which the player cannot control the outcome) or pseudo-random fashion (e.g. such as where the game includes a skill component which can affect the outcome of the game).

Preferably, the controller is configured to execute machine readable code or instructions (e.g. software) which are configured to implement the game. In this regard, the gaming machine 24 is specially configured to present the game of the invention via specific software and/or hardware which causes the gaming machine to operate uniquely. For example, the controller of the gaming machine 24 may be configured to detect a wager, such as a signal from a player's depressing of an "game bet" button. Upon such an event and/or the player otherwise signaling the gaming machine to present the game, the controller may be configured to cause the at least one display to display unique information, such as a unique graphical interface or unique game display, including images of playing cards (including as part of player and/or dealer hands and/or community cards) or other game information. The controller may accept input from a player of game inputs via the one or more player input devices of the gaming machine 24. As indicated above, the machine readable code may be configured in various manners, such as by having various "modules" of software which are designed to implement specific features of the game play or game presentation.

The gaming machine 24 may be configured to generate and present games in a stand-alone manner or it may be in communication with one or more external devices or systems at one or more times. The gaming machine 24 might communicate with one or more of such external devices or systems via one or more communication ports or other interface devices. These ports or interface devices may be configured to implement various communication protocols (including proprietary protocols) and communicate via wireless, wired or other communication link. For example, the gaming machine 24 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 24 is configured to present one or more wagering games. The gaming machines 24 is preferably configured to accept value, such as in the form of coins, tokens, paper currency or other elements or devices representing value such as monetary funds. Thus, as indicated above, the gaming machine 24 preferably includes a mechanism or means for accepting monetary value. For example, the gaming machine 24 might include a coin acceptor 732 for accepting coins. Of course, associated coin reading/verifying devices and coin storage devices may be associated with the gaming machine 24 if it is configured to accept coins. Likewise, the gaming machine 24 might include a media reader. Such a reader may be configured to accept and read/verify paper currency and/or other media such as tickets. Of course, in such event the gaming machine 24 may further be configured with one or more paper currency or ticket storage devices, such as cash boxes, and other paper currency or media handling devices (including transport devices).

The gaming machine 24 might also be configured to read FOBs, magnetic stripe cards or other media having data associated therewith and via which value or funds may be associated with the gaming machine 24. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system.

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). Such wager input options may allow the player to wager on the base game and optionally place a side bonus bet in accordance with the present invention. In one embodiment, when the player's wager is received, the player's credit balance is reduced by the number of wagered credits. The player might then provide a separate input to begin the game. In other embodiment, the player might select a "play game" input, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 24 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 24 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 24 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In this regard, the gaming machine 24 may include one or more media printers or writers. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 24 may also include a player tracking device, such as a card reader and/or an associated keypad or other input device (such as a touch screen display). Such player tracking devices are well known and may permit the game operator to track play of players of the gaming machine. The tracked play may be utilized to offer player bonuses or awards.

The main game controller or processor may communicate with several of the peripheral devices via one or more intermediary controllers. For example, some of the peripheral devices might comprise USB type or enabled devices which are controlled by an intermediary USB controller.

Figure 2:
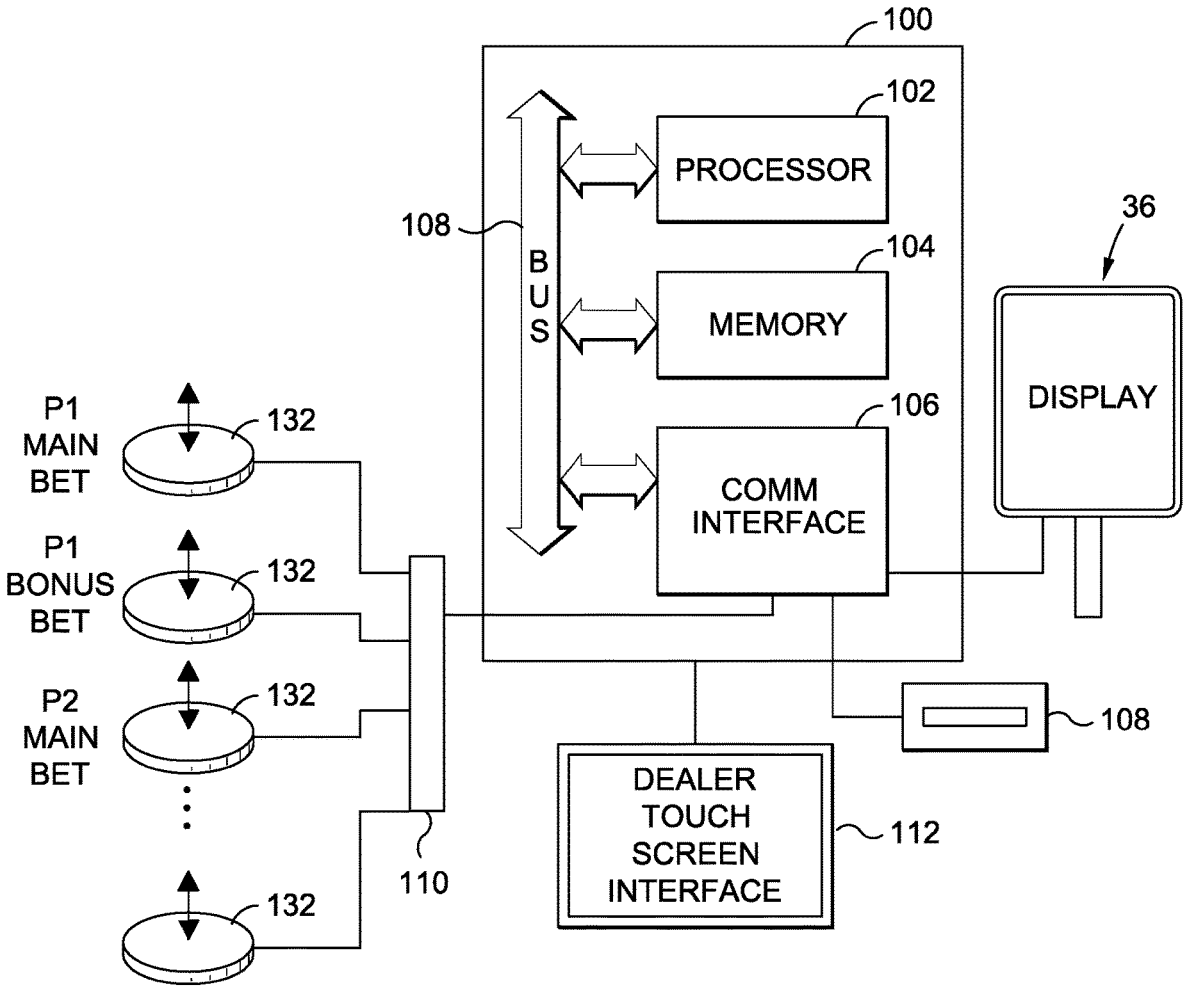
FIG. 2 illustrates aspects of a gaming table in accordance with an embodiment of the invention.

Still referring to FIG. 2, in one embodiment, the system 20 includes an awards server 26. The awards server 26 may comprise a processor which is configured to execute machine-readable code (e.g. "software") stored in an associated memory, which software is preferably configured to cause the processor to implement the functionality described herein. In one embodiment, a database 28 may be associated with the awards server 26, such as for storing information as described below.

In one embodiment, the awards server 26 may include one or more operator interfaces, such as operator terminals (not shown). Such interfaces might comprise, for example, terminals which include at least one display and one or more user input devices such as a keyboard, mouse, touch-screen, etc. The interfaces may communicate with the awards server 26, such as to configure the server 26, display information and the like.

In one embodiment, the awards server 26 may be part of one or more other servers or systems, or be integrated therewith. Such systems or servers might comprise a casino accounting system, casino player tracking system or the like.

In one embodiment, the awards server 26 is configured to communicate with the casino gaming devices, such as the gaming tables 22 and gaming machines 24. In one embodiment, the awards server 26 includes at least one communication interface for communicating with the gaming devices, such as over one or more wired and/or wireless communication links, which links may comprise part of a LAN, WAN or the like.

In one embodiment, the awards server 26 is configured to receive information regarding wagers placed at the gaming devices, such as the gaming tables 22 and gaming machines 24, preferably in a manner which distinguishes between or specifically designates the wagers made at those devices. As detailed below, the awards server 26 preferably utilizes this information as part of determining secondary awards.

In one embodiment, each time a player makes a wager at a gaming machine 24, the gaming machine reports the wager, including the amount of the wager, to the awards server 26. In one embodiment, this information may be reported by the controller of the gaming machine, such as via a slot accounting system (SAS) interface of the gaming machine. The gaming machine 24 may report wager information with associated information regarding a game upon which the wager is placed (if the gaming machine only offers a single game, the gaming machine may report the wager with a machine ID and then the awards server 26 may use the machine ID to identify the particular game that the wager was placed upon; in cases where the gaming machine is a multi-game machine, the gaming machine may identify the particular game upon which the wager was placed).

Preferably, wager information is also linked to a player. Thus, as described above, a player may identify themselves using a player tracking card (or via input of a player tracking number or code, etc.). The awards server 26 may then identify the wagers placed by a particular player at a gaming machine.

In the case of the gaming tables 22, wager information may be collected and reported in various manners.

First, if a gaming machine 22 is not configured to automatically track wagers placed, a dealer might input wager information. For example, a dealer might be provided with an interface, such as a touch screen interface or other input device, via which the dealer may input player identification information, such as to a table controller. As illustrated in FIG. 2, such a table controller 100 may comprise at least one processor 102 which is configured to execute machine readable code fixed in a tangible medium (e.g. "software"). The table controller 100 may also comprise one or more information or data storage devices 104. These data storage devices 104 may comprise any type of data storage device such as ROM, RAM, EPROM or the like, as well as mass storage devices such as hard drives. The data storage devices 104 may store various data, including game code or software which is executable by the processor(s) 102 and other data, such as game data including wager data, game outcome data, images, etc.

The table controller 100 preferably includes one or more communication interfaces 106. The communication interface(s) 106 may facilitate wireless and/or wired communications with one or more remote systems or devices in accordance with various protocols (USB, Wi-Fi, Bluetooth, Ethernet, Firewire, etc.). In one embodiment, data or information may be exchanged between the processor(s) 102, data storage device(s) 104 and communication interface(s) 106 via one or more interfaces, such as a system bus 108. Of course, the table controller 100 might have other configurations, including other elements or features, including as described herein.

As one example, a dealer might swipe/read player tracking cards via a card reader 108 which is associated with the table controller 100, and then assign players to designated positions, such as using a dealer touch screen interface 112. For example, the interface might identify: Position 1: Player 3434—John Smith; Position 2: Open; Position 3: Player 5839—Susy Jones. The dealer might then manually enter wager information for each player. For example, when the player at Position 1 places a $50 main game wager (such as by tendering $50 in chips), the dealer might provide input "Position 1", "Main Game", "$50."

In other embodiments, the gaming table 22 might be configured to automatically track or capture information regarding wagers which are placed at the table. Wagers placed by players may be sensed by detecting the association of one or gaming chips (or monies or other wagering implements) with one or more input receiving devices or input sensors 132. The input receiving devices or input sensors 132 might comprise buttons (wired or wireless), or other input devices, including RFID chip readers, proximity sensors and other types of sensors. The input receiving devices 132 may be located in or on the game table 22 and are configured to detect inputs, such as provided by players at the playing surface. In the case of proximity sensors, the sensors may be any type of proximity sensor now known or later developed, such as IR, acoustic, capacitive, or the like.

In one embodiment, as illustrated in FIG. 2, one or more input receiving devices 132 are associated with each player position, thereby providing a means for each player to provide input relative to game play at the gaming table (and whereby the wagers of each player may be distinguished from those of the other players). For example, relative to a card game have a required base game wager and an optional bonus wager, a first receiving device 132 might be configured to receive or detect a main game wager placed by a player at position 1, and a second receiving device 132 might be configured to receive or detect a bonus game wager placed by the player at position 1 (and so on, where input receiving devices 132 are provided for each position/player and for each wager).

These input receiving device 132 are interfaced with the table controller 100 so that the table controller 100 may receive information from those devices 132 and, in some embodiments, to transmit information to those devices. The gaming system might include other elements, such as input receiving device controllers or the like. In one embodiment, the input receiving devices 132 communicate with a hub or aggregator 110 which communicates with the table controller 100. The hub 110 may be configured to read or determine the status of each input receiving device 132 and provide information to the table controller 100, such as when the status of an input receiving device 132 changes (for example, an input receiving device 132 might be configured to transition between "bet receiving" and "bet closed" modes). The hub 110 may also comprise a power source for the input receiving devices 100. As another example, a proximity-type input sensor might be configured as a USB type device having a USB controller. The table controller 100 may be configured to control the proximity device as a USB device. In this regard, the processor 102 and/or one or more sub-processors or controllers may be utilized to control the input receiving devices.

Collected wager information may be transmitted from the table controller 100 to the award server 26.

Of course, various other means may be provided for receiving wager information and providing wager information to the award server 26. As one example, a player might place wagers at the gaming table 22 from funds associated with a player account, such as by input to an electronic interface. Such an interface may again be associated with a table controller or might be linked to a remote player account system, whereby wagers placed may be reported to the award server 26.

In one embodiment of the invention, the award server 26 is configured to award secondary awards. In one embodiment, each wager that a player places provides them with an opportunity to win or be rewarded a secondary award. In a preferred embodiment, a player is provided with different opportunities for a secondary award based upon differences in a value of the player's wager to the casino. In one embodiment, a player may be awarded opportunities for a secondary award, such as entries, where the number of opportunities or entries may depend upon the value of the player's wager to the casino. In one preferred embodiment, each opportunity or entry has a chance to win, such as having its own winning or losing outcome. As other aspects of the invention, secondary awards may be funded from game wagers, wherein an amount of the wager which is used to fund the secondary award may vary from wager to wager, depending upon the value of the wager to the casino. Additional aspects of the invention will be appreciated from the following non-limiting examples of the invention.

As one aspect of the invention, a casino (or operator) may determine a value of one or more secondary awards to award as prizes. Preferably, according to the invention, a casino funds the secondary awards from winnings placed on existing game wagers—e.g. the player has an opportunity to win a secondary award without having to place a separate, additional wager for the chance to win the secondary award. Instead, the player has the opportunity to win the event that they placed their wager upon (such as a main game, bonus event, etc.) and a chance for a secondary award.

Table 1 illustrates an exemplary embodiment of a casino having 100 gaming devices with an average daily coin-in of $1,000,000 and an average daily win or hold of $34,000. The casino may desire to fund the one or more secondary awards from this daily win or hold. As one example, the casino might fund the one or more secondary awards from a percentage or amount of each wager placed on a wagering event. As one example using a sample breakdown of total daily coin-in, the casino might fund the one or more secondary awards at a level which is equivalent to 0.4% of the daily coin in, or 11.76% of the house hold, or $4,000 per day.

TABLE 1

| Field | Input |
|---|---|
| Daily Coin In/Unit | 10000 |
| Units | 100 |
| Hold | 3.40% |
| Win/Unit | $340 |
| Total Daily Coin In | 1,000,000 |
| Total Daily Win | $34,000 |
| Avg % Handle Allocated for Meters | 0.40% |
| Average Daily Increment | $4,000 |
| Amount of Daily Entries | 800,000 |

The casino may generate a prize table of the secondary prizes to be awarded, as funded by the desired level of funding. The prizes may be of any type, including monetary awards, free or reduced price goods or services (such as a buffet voucher, free room voucher, jacket, etc.).

As one example, relative to the above-described example in which a casino has allocated $4,000 per day of its winnings to secondary awards, the awards might comprise progressive monetary jackpots. One example of jackpot configurations and jackpot meter funding is illustrated in Table 2 below.

TABLE 2

| Jack-pots | Starting Meter | Daily Accrual per Meter | Odds to Win (per Entry) | Average Meter | Jack-pots Per Day | Allocate to Seed | Allocate to Incre-ment | Amount to Seed | Amount to Incre-ment |
|---|---|---|---|---|---|---|---|---|---|
| Meter 1 | $10 | $800 | 20,000 | $20 | 40 | 50% | 50% | 10.00 | 10.00 |
| Meter 2 | $25 | $800 | 50,000 | $50 | 16 | 50% | 50% | 25.00 | 25.00 |
| Meter 3 | $100 | $800 | 200,000 | $200 | 4 | 50% | 50% | 100.00 | 100.00 |
| Meter 4 | $200 | $800 | 400,000 | $400 | 2 | 50% | 50% | 200.00 | 200.00 |
| Meter 5 | $1,000 | $800 | 2,000,000 | $2,000 | 0.4 | 50% | 50% | 1000.00 | 1000.00 |

In one embodiment, a player is given one or more chances to win a secondary award based upon each wager that they place. In a preferred embodiment, the number of chances depending upon the value of the wager to the casino. One example of this principle will be described with reference to Tables 3 and 4.

As indicated above, wagers for different games and even different wagers upon the same game, may have different house advantages. In other words, wagers of the same amount which are placed on two different games or two different game events might have entirely different "profitability" to the casino, as measured by the advantage to the house for that wager.

Table 3 set forth below illustrates some examples of different house advantages for different wagers on the same and different games.

TABLE 3

| Game Type | Wager | House Advantage |
|---|---|---|
| Baccarat | Player/Banker | 1.14% |
| | Tie | 14.00% |
| | Side wager | 7.00% |

TABLE 3-continued

| Game Type | Wager | House Advantage |
|---|---|---|
| Roulette | Roulette | 5.26% |
| Blackjack | Blackjack (6 to 5) | 2.70% |
| | Side Wager | 8.00% |
| Novelty | EZ 3 Card Main | 1.75% |
| | Natural Pair Plus | 8.00% |
| | Crazy 8 | 9.00% |

Of course, this table is just one example if different games and different wagers per game and associated house advantages. The house advantage for other games or events, including side bets and the like, are dependent upon the games/events and their rules.

Next as illustrated in Table 4, an allocation of each wager to the prize pool is determined. Most importantly, the allocation varies depending upon the value of the wager to the casino—e.g. is different for different wagers. In one embodiment, the wager(s) with the lowest house advantage may be set to a base value and then all other wagers may be set to increments of the base value depending upon their house advantage. Table 4 illustrates an example of the wager allocations for the wagers illustrated in FIG. 3, wherein the base value or allocation is $0.005.

TABLE 4

| Wager Type | Allocation to Jackpot Meters | Min. Wager | Min. Wager Accrual |
|---|---|---|---|
| Player/Banker | 0.10% | $5 | $0.005 |
| Tie | 3.00% | $1 | $0.030 |
| Side wager | 2.00% | $1 | $0.020 |
| Roulette | 0.50% | $5 | $0.025 |
| Blackjack (6 to 5) | 0.30% | $5 | $0.015 |
| Side Wager | 2.00% | $1 | $0.020 |
| EZ 3 Card Main | 0.20% | $5 | $0.010 |
| Natural Pair Plus | 2.00% | $1 | $0.020 |
| Crazy 8 | 2.00% | $1 | $0.020 |
| Base Value of an Entry | | | $0.005 |

In one embodiment, a player is provided with a secondary prize opportunity for each wager allocation. As described below, each secondary prize opportunity may comprise a prize entry. As can be seen in Table 1, using a base allocation of $0.005, when $4000/day is allocated to funding of the prize pool, 800,000 entries would be generated ($4000/$0.005).

In this configuration, the number of prize opportunity, such as entries, which are awarded to a player depends upon the size of the player's wager. For example, as illustrated in Table 4 above, if a player made a $5 player or banker hand wager in baccarat, the player would be entitled to 1 entry. As illustrated in Table 5, if a player made a $50 player or banker hand wager—e.g. 10 times as much, then the player would be entitled to 10 entries. Likewise, if a player made a $5 Blackjack wager, then as illustrated in FIG. 4, the player would be entitled to 3 entries (since the wager allocation is $0.015, which is 3 times the base allocation of $0.005) and if the player made a $50 Blackjack wager, as illustrated in Table 5, the player would then be entitled to 10 times as many entries, or x*10, or 30 entries. Table 5 illustrates examples of numbers of entries for different wager amounts.

TABLE 5

| Examples of Entries | Bet Amount | Entries |
|---|---|---|
| Roulette | $50 | 50 |
| Baccarat Player/Banker | $50 | 10 |
| Blackjack | $50 | 30 |
| Blackjack Side Wager | $5 | 20 |
| EZ 3 Card Main | $25 | 10 |
| Baccarat Tie Wager | $5 | 30 |
| Blackjack | $250 | 150 |

As indicated, in one embodiment, a player receives one or more opportunities, such as entries, for each wager placed. These entries are preferably used to determine if the player receives a secondary award. Secondary awards might be rewarded, such as selected or determined, in various manners. For example, in one embodiment, all player entries might be placed into a drawing (such as daily), wherein entries are selected or drawn for secondary awards. For example, referring to Table 2, a number of different jackpots may be awarded each day (such as 40 of Jackpot Meter 1, 16 of Jackpot Meter 2, etc.). All entries for a day might be placed in a pool and then 40 entries might be selected which are each awarded the Meter 1 amount, then 16 entries may be selected which are each awarded the Meter 2 amount, etc.)

In a preferred embodiment, however, each entry is independently determined to be winning or losing. One example of such a secondary award determination will be described with reference to Table 6. In one embodiment, a virtual box of entries is generated. The virtual box may have a large number of entries for statistical odds stability (as compared to the odds of winning the individual prizes per the prize table, such as that in Table 2). For example, Table 2 illustrates an example where a top prize has odds to win of 2,000,000 to 1. Thus, the virtual box preferably has at least 2,000,000 entries (1 of which would be the jackpot prize of Meter 5). In order to create a pool of a larger (essentially infinite, but without being infinite) entries, the virtual box might thus have 10,000,000 entries. The entries would be designated as winning or losing. In this case, there would be 780 winning entries and 9,999,220 losing entries. Of the winning entries, there would be 500 winners of the jackpot Meter 1 amount, 200 of the Meter 2 amount, 50 of the Meter 3 amount, 25 of the Meter 4 amount, and 5 of the Meter 5 amount.

TABLE 6

| Total Entries in the Box | 10,000,000 |
|---|---|
| Jackpot | Winners |
| Meter 1 | 500 |
| Meter 2 | 200 |
| Meter 3 | 50 |
| Meter 4 | 25 |
| Meter 5 | 5 |
| Total Winners | 780 |
| Total Prize Value per Virtual Box | $50,000 |

It will be seen that the value of the winning entries in the virtual box comprises $50,000. Since there are 10,000,000 entries and each entry has a prize pool funding allocation of $0.005, the portions of all of the player wagers thus fund the pool to an amount of $50,000 (10,000,000 entries× $0.005=$50,000).

In this configuration, for each entry awarded to a player, an entry is randomly selected from the virtual box and the outcome of that entry is determined to be winning or losing. As indicated, depending upon the wager made by the player, may result in multiple entries. For example, relative to Table 5, if a player made a $50 player or banker hand wager in baccarat, they would receive or be assigned 10 entries, while a player who made a $5 "tie" wager in baccarat would receive 30 entries.

In one embodiment, for each entry that a player receives, one of the entries in the virtual box is preferably randomly selected and the result of that entry is determined. Entries might be selected or assigned in various manners. For example, a random number generator might be used to randomly generate numbers between 1 and 10,000,000. When the player receives an entry, one of the randomly generated numbers is selected and is then matched to the virtual box outcomes to determine if the selected outcome is losing or winning and, if winning, what prize is associated with the winning.

Preferably, the method and system of the invention are automated. The award server 26 is programmed with a table of wager events, wherein each wager event has a secondary award funding value a designation of one or more award opportunities, such as prize entries, in the manner described above. Information regarding a wager placed by a player is transmitted from a gaming device, such as a gaming table 22 or gaming machine 24, to the award server 26. The wager may be compared to the table for a determination of the secondary award funding value and number of award opportunities/entries. In the event entries are awarded to the player, then each entry may be evaluated for a winning or losing outcome in the manner described above, such as by reference to virtual box outcome.

Information may be displayed to the player regarding the number of secondary award opportunities or entries they have been awarded, and whether they have won any secondary awards. This information might be displayed on one of the displays of the gaming machine 24, or as illustrated in FIG. 2, a display 36 associated with a gaming table 22. For example, at a gaming table 24, the display 36 might display "Player 1: 5 ENTRIES. ENTRY 1: LOSING; ENTRY 2: LOSING: ENTRY 3: WIN $500!!; ENTRY 4: LOSING; ENTRY 5: WIN $50!!" and then "Player 2: 1 ENTRY. ENTRY 1: LOSING", etc. Of course, information regarding secondary awards might be provided in various other manners.

As indicated above, the wagers by each player are preferably tracked (either to a gaming machine, table position or, more preferably, specifically to their player tracking ID). This allows the casino to match winning outcomes to particular players so that winning awards can be provided to the player. For example, in the case of a monetary value secondary award, the award might be credited to the credit meter of the gaming machine 24 that the player is playing. In the case of a gaming table 22, the dealer might award chips to the player in an amount equal to the secondary award. In the case of non-monetary promotional awards, the awards might be distributed manually (such as by manually awarding a buffet voucher to the player) or might be associated with the player's tracking/rewards account for later redemption (such as by having the award server 26 communicate with the casino's player tracking/rewards server).

The invention may have various other features or configurations. Among other things, aspects of the invention can be used alone or in combination, including in combination with other systems, methods and features.

For example, as noted above, in one embodiment a player may be provided opportunities, such as entries, which vary depending upon the "value" of the particular wager being place (such as varying depending upon the house advantage for the wager). While the outcome of those prize entries may be determined using the preferred process described above, the outcomes of the prize entries might be determined in other fashions. For example, as noted above, a player's prize entries might be placed into a drawing where one or more winning entries are selected and the remaining entries are then determined to be losing entries.

As indicated, the secondary awards may be of various types. Tables 2 and 6 are examples of a configuration in which the secondary awards are progressive monetary jackpots. However, the secondary awards might comprise fixed value monetary awards. Also, Tables 7 and 8 below illustrate an example of a prize configuration and a virtual box of entries for secondary awards comprising a combination of fixed value awards and promotional awards.

TABLE 7

| Jackpots | Prize | Odds to Win (per Entry) | Prize Face Value | Cost | Allocation of Prize Pool | Prizes Per Day |
|---|---|---|---|---|---|---|
| Prize 1 | $10 Free Bet | 10,000 | $10 | $5.00 | 400 | 80.00 |
| Prize 2 | $25 Free Bet | 25,000 | $25 | $12.50 | 400 | 32.00 |
| Prize 3 | $50 Free Bet | 50,000 | $50 | $25.00 | 400 | 16.00 |
| Prize 4 | Food Voucher $10 | 14,000 | $10 | $7.00 | 400 | 57.14 |
| Prize 5 | Food Voucher $25 | 35,000 | $25 | $17.50 | 400 | 22.86 |
| Prize 6 | $25 | 50,000 | $25 | $25.00 | 400 | 16.00 |
| Prize 7 | $50 | 100,000 | $50 | $50.00 | 400 | 8.00 |
| Prize 8 | $100 | 200,000 | $100 | $100.00 | 400 | 4.00 |
| Prize 9 | $250 | 500,000 | $250 | $250.00 | 400 | 1.60 |
| Prize 10 | $1,000 | 2,000,000 | $1,000 | $1,000.00 | 400 | 0.40 |

TABLE 8

| Total Entries in the Box | | 10,000,000 | |
|---|---|---|---|
| Prize | Winners | Prize | Winners |
| $10 Free Bet | 1,000 | $25 | 200 |
| $25 Free Bet | 400 | $50 | 100 |
| $50 Free Bet | 200 | $100 | 50 |
| Food Voucher $10 | 714 | $250 | 20 |
| Food Voucher $25 | 286 | $1,000 | 5 |
| Total Winners | | 2,975 | |
| Total Prize Value per Virtual Box | | $50,000 | |

Tables 9 and 10 below illustrate an example of a prize configuration and virtual box of entries for secondary awards comprising a combination of promotional awards and progressive monetary jackpots.

TABLE 9

| Jack-pots | Starting Meter | Daily Accrual per Meter | Odds to Win (per Entry) | Average Meter | Jack-pots per Day | Allocate to Seed | Allocate to Incre-ment | Amount to Seed | Amount to Incre-ment |
|---|---|---|---|---|---|---|---|---|---|
| Meter 1 | $10 | $400 | 40,000 | $20 | 20 | 50% | 50% | 10.00 | 10.00 |
| Meter 2 | $20 | $400 | 80,000 | $40 | 10 | 50% | 50% | 20.00 | 20.00 |
| Meter 3 | $50 | $400 | 200,000 | $100 | 4 | 50% | 50% | 50.00 | 50.00 |
| Meter 4 | $125 | $400 | 500,000 | $250 | 1.6 | 50% | 50% | 125.00 | 125.00 |
| Meter 5 | $1,000 | $400 | 4,000,000 | $2,000 | 0.2 | 50% | 50% | 1000.00 | 1000.00 |

| Jackpots | Prize | Allocation of Prize Pool | Odds to Win (per Entry) | Prize Face Value | Cost | Prizes Per Day |
|---|---|---|---|---|---|---|
| Prize 1 | $10 Free Bet | 400 | 10,000 | $10 | $5.00 | 80.00 |
| Prize 2 | $25 Free Bet | 400 | 25,000 | $25 | $12.50 | 32.00 |
| Prize 3 | $50 Free Bet | 400 | 50,000 | $50 | $25.00 | 16.00 |
| Prize 4 | Food Voucher $10 | 400 | 14,000 | $10 | $7.00 | 57.14 |
| Prize 5 | Food Voucher $25 | 400 | 35,000 | $25 | $17.50 | 22.86 |

TABLE 10

| Total Entries in the Box | | 12,000,000 | |
|---|---|---|---|
| Prize | Winners | Prize | Winners |
| Meter 1 | 300 | $10 Free Bet | 1,200 |
| Meter 2 | 150 | $25 Free Bet | 480 |
| Meter 3 | 60 | $50 Free Bet | 240 |
| Meter 4 | 24 | Food Voucher $10 | 857 |
| Meter 5 | 3 | Food Voucher $25 | 343 |
| Total Winners | | 3,657 | |
| Total Prize Value per Virtual Box | | $60,000 | |

In the example above, in one embodiment, awarded entries may be "drawn" from a virtual box of prizes. In one embodiment, awarded entries might be drawn or matched to virtual outcomes in the prize box on a one-to-one basis (e.g. where the prize box depletes as entries are awarded and matched to an outcome in the box). In this configuration, however, as prizes are awarded from the virtual box, they are effectively no longer available to be won by players who are later awarded entries. For example, a virtual box might have 1000 outcomes and just two of those outcomes might be a designated $500 award. If the first two entries which are awarded result in the 2 $500 awards being selected, the remaining 998 entries could not result in the award of a $500 award.

Thus, in one embodiment, a prize box of a very large number of outcomes may be set up. Further, after such a prize box has only been partially depleted, such as to about 70% of the outcomes, then the prize box could be reset. This effectively results in each entry having a high probability of being able to result in any of the winning prize outcomes. In another configuration, multiple prize boxes could be set up and run simultaneously and entries could be selected from the different prize boxes, thus also rendering more likely that each entry has a chance to win every prize. Of course, other methodologies might be implemented for ensuing that each awarded entry and a relative probability of a chance to win any of the secondary awards or prizes which exist.

As indicated above, the determination of the amount of each different wager to allocate to fund the prize pool (including, if desired, which wagering events to include and number of allocations or entries per wagering event) ultimately affects the average amount of the casino's hold or handle that is allocated to the secondary prize system (whereby the casino may modify those parameter to change the average amount of the casino's house hold or handle that is "spent" on the secondary awards. Tables 11-13 show three different examples this concept:

TABLE 11

| Wager | Handle (Coin in) | Win | Promo Fund | Entries |
|---|---|---|---|---|
| Player/Banker | 175,000 | 1,995 | 175 | 35,000 |
| Tie | 5,000 | 700 | 150 | 30,000 |
| Side wager | 20,000 | 1,400 | 400 | 80,000 |
| Roulette | 300,000 | 15,780 | 1500 | 300,000 |
| Blackjack (6 to 5) | 240,000 | 6,480 | 720 | 144,000 |
| Side Wager | 30,000 | 2,400 | 600 | 120,000 |
| EZ 3 Card Main | 160,000 | 2,800 | 320 | 64,000 |
| Natural Pair Plus | 50,000 | 4,000 | 1000 | 200,000 |
| Crazy 8 | 20,000 | 1,800 | 400 | 80,000 |
| Total | 1,000,000 | 37,355 | 5265 | 1,053,000 |
| Avg % Handle Allocated for Meters | | | 0.527% | |

TABLE 12

| Wager | Handle (Coin in) | Win | Promo Fund | Entries |
|---|---|---|---|---|
| Player/Banker | 300,000 | 3,420 | 300 | 60,000 |
| Tie | 10,000 | 1,400 | 300 | 60,000 |
| Side wager | 40,000 | 2,800 | 800 | 160,000 |
| Roulette | 300,000 | 15,780 | 1500 | 300,000 |
| Blackjack (6 to 5) | 300,000 | 8,100 | 900 | 180,000 |
| Side Wager | 50,000 | 4,000 | 1000 | 200,000 |
| EZ 3 Card Main | | 0 | 0 | 0 |
| Natural Pair Plus | | 0 | 0 | 0 |
| Crazy 8 | | 0 | 0 | 0 |
| Total | 1,000,000 | 35,500 | 4800 | 960,000 |
| Avg % Handle Allocated for Meters | | | 0.480% | |

TABLE 13

| Wager | Handle (Coin in) | Win | Promo Fund | Entries |
|---|---|---|---|---|
| Player/Banker | 310,000 | 3,534 | 310 | 62,000 |
| Tie | | 0 | 0 | 0 |
| Side wager | 50,000 | 3,500 | 1000 | 200,000 |
| Roulette | 300,000 | 15,780 | 1500 | 300,000 |
| Blackjack (6 to 5) | 330,000 | 8,910 | 990 | 198,000 |
| Side Wager | 10,000 | 800 | 200 | 40,000 |
| EZ 3 Card Main | | 0 | 0 | 0 |
| Natural Pair Plus | | 0 | 0 | 0 |
| Crazy 8 | | 0 | 0 | 0 |
| Total | 1,000,000 | 32,524 | 4000 | 800,000 |
| Avg % Handle Allocated for Meters | | | 0.400% | |

As indicated herein, the principles of the invention may be applied to various wagering game events, whether such events are presented at one or more gaming tables, gaming machines or other devices, including via on-line gaming (such as presented over the Internet, such as via mobile communication devices, tablets, laptops or other computers, such as via one or more servers). For example, a portion of different wagers placed on online wagering events may be allocated to a secondary award fund and those players may be awarded secondary prize opportunities.

The present invention has numerous aspects and advantages.

One embodiment of the invention is a system and method for awarding secondary prizes where there are different allocations of funds to a prize pool based upon wagers placed on wagering events having different house advantages.

Another embodiment of the invention is a system and method for awarding secondary prizes where a player receives a different number of opportunities, such as prize entries, for wagers placed on different wagering events having different house advantages, and preferably where each prize entry has its own win/lose outcome.

Another embodiment of the invention is a system and method for awarding secondary prize opportunities, such as entries, as funded by underlying game wagers, where the number of opportunities varies based upon the underlying wagering event (and particularly, the house advantage) and there is a win/lose outcome for each secondary prize entry.

Yet another embodiment of the invention is a system and method for developing a prize pool that joins two or more game types and multiple different wager types within each game, and allows each wager type/game type to participate in the same prize pool.

One aspect of the invention is a system and method which allows players to win prizes based on accruing opportunities, such as entries, that are dependent on the value of each wager that they make. Each wager is assigned a certain number of entries based on the total worth of the wager. The system effectively allocates or assigns a portion of the casino's advantage for each wager and applies that allocation to a prize fund that can be used for prizes that can be won by the players. The prize pool can consist of progressive prize pools, promotional awards such as food credits, and cash prizes.

One advantage of the invention is a method and system by which each wager made by a player is distinctly rewarded with an opportunity for a secondary award. In particular, each wager made by a player (whether such comprises a wager on a first type of game vs. a wager on a second type of game, or a wager on a base game and a bonus wager on the same game, etc.) is provided with one or more opportunities for a secondary award, where the number of opportunities is dependent upon the value of the wager to the casino, such as the house hold or advantage for the particular wager. In this configuration, a player who places a wager having a high value to the house is provided with greater opportunities (such as entries) to win a secondary award than the same player or a different player who places a wager having a low value to the house. In addition, even different types of wagers within the same game (such as a base game wager vs. a bonus or side wager) can be treated entirely differently, e.g. can result in a differing number of entries to the player.

One advantage of the invention is a method and system by which the player's chance for a secondary award is immediately determined. As indicated above, in some cases a player might be awarded a prize drawing ticket for the play of a game, where a drawing is held at some later date. This may require the player to travel back to the casino for the drawing (such as in "must be present to win" drawings). In accordance with the present invention, the outcome the entries which are awarded to a player may immediately be determined. For example, relative to a game of blackjack or roulette, the outcomes of all entries earned by a player based upon the wagers placed during the hand of blackjack or the roulette wheel spin may be determined at the end of the hand/spin, along with the outcomes of the main game wagers that the player placed that triggered the secondary award opportunity(ies).

One preferred method to determine a winner is to have a virtual box that houses "X" amount of entries (such as 10,000,000). Of this population of entries are the corresponding amount of winning entries as determined by the value of each prize along with the chance of winning the prize and the proportional amount of losing entries. If a player has earned "Y" entries during a round of play, the system will pick out "Y" virtual entries from the virtual box and determine if the player has won, relative to each of those entries, a prize (e.g., in such a configuration, if a player is awarded two or more entries, each of those entries might be winning).

As indicated herein, the invention solves various problems with existing systems and methods for awarding secondary or additional awards to players. The invention comprises a technological/technical solution to those problems. In particular, an aspect of the invention is a unique system which is configured to collect wagering information associated with different wagering events at different gaming devices, which utilizes specially configured software and data tables or structures to utilize the collected wagering information (by analyzing/manipulating the collected information) to generate secondary award funding allocations and award secondary award opportunities or entries, and to determine the outcomes of those opportunities/awards (such as by also implementing a secondary award prize outcome determining system).

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of awarding secondary awards to players of a first gaming device configured to present a first wagering event based upon a first wager and of a second gaming device configured to present a second wagering event based upon a second wager, wherein said first wagering event has a first house advantage and said second wagering event has a second house advantage which is smaller than said first house advantage, comprising the steps of:

receiving, at an awards server comprising a processor, at least one associated memory, and machine-readable code stored in said memory, information regarding an amount of said first wager placed at said first gaming device and information regarding an amount of said second wager placed at said second gaming device;

storing, in said memory associated with said awards server, a first data table that defines a first number of secondary award prize opportunities to be awarded for a first base wager upon said first wagering event and a number of secondary award prize opportunities to be awarded for a second base wager upon said second wagering event, wherein said first number of secondary award prize opportunities is greater than said second number of secondary award prize opportunities, when said first and second base wagers are the same amount;

determining, based upon said data table, a first total number of secondary award prize opportunities to be awarded to said first player based upon said amount of said first wager in proportion to the first base wager, and a second total number of secondary award prize opportunities to be awarded to said second player based upon said amount of said second wager in proportion to said second base wager;

storing, in said memory, a data table of a plurality of entry outcomes, one or more of said outcomes comprising winning secondary awards and one or more of said outcomes comprising losing outcomes;

randomly assigning each of said first total number of secondary award prize opportunities and each of said second total number of secondary ward prize opportunities to said plurality of entry outcomes;

determining an outcome of each of said first total number of secondary award prize opportunities and said second total number of secondary award prize opportunities based upon whether the corresponding entry outcome comprises a winning secondary award or comprises a losing outcome;

causing a video display of said first gaming device to graphically display an outcome of said secondary prize award opportunity based upon said outcomes of said first total number of electronic secondary award prize entries and causing a video display of said second gaming device to graphically display an outcome of said secondary prize award opportunity based upon said outcomes of said second total number of electronic secondary award prize entries; and funding, via said awards server, said secondary awards with a portion of said first wager and a portion of said second wager, said portion of said first wager and said portion of said second wager differing based upon said differences in said first and second house advantages.

2. The method in accordance with claim 1, wherein said secondary award prize opportunities comprise entries.

3. The method in accordance with claim 1, wherein said first total number of secondary award opportunities is greater than said second total number of award opportunities and said portion of said first wager is greater than said portion of said second wager.

4. The method in accordance with claim 1, wherein said first wagering event comprises a first wager on a first game and said second wagering event comprises a second wager on a second game.

5. The method in accordance with claim 1, wherein said first wager comprises multiple wagers on said first wagering event and wherein said second wager comprises multiple wagers on said second wagering event.

6. The method in accordance with claim 5, wherein said first wager comprises a main game wager on said first wagering event and a bonus or side wager on said first wagering event.

7. The method in accordance with claim 1, wherein said secondary awards comprise one or more progressive monetary jackpots.

8. The method in accordance with claim 1, wherein said secondary awards comprise at least one of a monetary award and a promotional award.

9. A method of generating normalized secondary award opportunities to a player of a first gaming device configured to present a first wagering event based upon a first wager and a player of a second gaming device configured to present a second wagering event based upon a second wager, where said first wagering event has a first house advantage and said second wagering event has a second house advantage which is smaller than said first house advantage, comprising the steps of:

receiving, at an awards server comprising a processor, at least one associated memory, and machine-readable code stored in said memory, information regarding an amount of said first wager placed at said first gaming device and information regarding an amount of said second wager placed at said second gaming device;

transforming said first wager into first total number of electronic secondary award prize entries and said second wager into a second total number of electronic secondary award prize entries, wherein said first total number of secondary award prize entries and said second total number of secondary award prize entries are normalized in relation to said first and second house advantages and an amount of said first wager to an amount of said second wager, comprising:

storing, in said memory associated with said awards server, a first data table that defines a first number of secondary award prize entries to be awarded for a first base wager upon said first wagering event and a number of secondary award prize entries to be awarded for a second base wager upon said second wagering event, wherein said first number of secondary award prize entries is greater than said second number of secondary award prize entries, when said first and second base wagers are the same amount;

determining, based upon said data table, said first total number of electronic secondary award prize entries to be awarded to said first player based upon said amount of said first wager in proportion to the first base wager, and said second total number of electronic secondary award prize entries to be awarded to said second player based upon said amount of said second wager in proportion to said second base wager; and electronically generating said first total number of secondary award prize entries and said second total number of secondary award prize entries;

transforming said first and second total number of electronic secondary award prize entries into secondary awards comprising:

storing, in said memory, a data table of a plurality of entry outcomes, one or more of said outcomes comprising winning secondary awards and one or more of said outcomes comprising losing outcomes;

randomly assigning each of said first total number of electronic secondary award prize entries and each of said second total number of electronic secondary award prize entries to said plurality of entry outcomes;

determining an outcome of each of said first total number of electronic secondary award prize entries and said second total number of electronic secondary award prize entries based upon whether the corresponding entry outcome comprises a winning secondary award or comprises a losing outcome; and causing a video display of said first gaming device to graphically display an outcome of said secondary prize award opportunity based upon said outcomes of said first total number of electronic secondary award prize entries and causing a video display of said second gaming device to graphically display an outcome of said secondary prize award opportunity based upon said outcomes of said second total number of electronic secondary award prize entries; and funding, via said awards server, said secondary awards with a portion of said first wager and a portion of said second wager, said portion of said first wager and said portion of said second wager differing based upon said differences in said first and second house advantages.

10. The method in accordance with claim 9, wherein said first and second gaming devices comprise at least one of a gaming machine and a gaming table.

11. The method in accordance with claim 9, wherein said secondary awards comprise one or more progressive monetary jackpots.

12. The method in accordance with claim 9, wherein said secondary awards comprise at least one of a monetary award and a promotional award.

13. The method in accordance with claim 9, wherein said data table of said plurality of entry outcomes comprises a virtual prize box of a fixed, large number of entry outcomes.

14. The method in accordance with claim 9, further comprising the step of generating said plurality of entry outcomes, wherein said secondary awards associated with said entry outcomes have a value which is equal to the number of said entry outcomes multiplied by a base allocation value of each wager to a secondary prize funding pool.

* * * * *